US008826870B2

(12) United States Patent
Green

(10) Patent No.: US 8,826,870 B2
(45) Date of Patent: Sep. 9, 2014

(54) TWO-STROKE ENGINE AND RELATED METHODS

(71) Applicant: Louis A. Green, Jamestown, OH (US)

(72) Inventor: Louis A. Green, Jamestown, OH (US)

( * ) Notice: Subject to any disclaimer, the term of this patent is extended or adjusted under 35 U.S.C. 154(b) by 0 days.

(21) Appl. No.: 13/959,211

(22) Filed: Aug. 5, 2013

(65) Prior Publication Data

US 2013/0319354 A1 Dec. 5, 2013

Related U.S. Application Data

(63) Continuation of application No. 12/421,350, filed on Apr. 9, 2009, now Pat. No. 8,505,504.

(51) Int. Cl.

| | |
|---|---|
| ***F02B 25/00*** | (2006.01) |
| ***F02B 1/02*** | (2006.01) |
| ***F02B 33/20*** | (2006.01) |
| ***F01L 7/02*** | (2006.01) |
| ***F02B 33/06*** | (2006.01) |
| ***F02B 25/18*** | (2006.01) |
| *F01P 1/06* | (2006.01) |
| *F02B 75/02* | (2006.01) |

(52) U.S. Cl.

CPC . *F02B 33/06* (2013.01); *F02B 1/02* (2013.01); *F02B 33/20* (2013.01); *F01L 7/026* (2013.01); *F01P 1/06* (2013.01); *F02B 25/18* (2013.01); *F02B 2075/025* (2013.01)

USPC .. 123/70 R; 123/51 B; 123/65 V; 123/65 VB; 123/68; 123/70 V

(58) Field of Classification Search

CPC ..... F02B 33/06; F02B 33/18; F02B 33/20; F02B 41/06; F02B 41/08; F02B 25/00

USPC ..... 123/51 B, 65 V, 65 VB, 68, 70 R, 70 V

See application file for complete search history.

(56) References Cited

U.S. PATENT DOCUMENTS

| | | | |
|---|---|---|---|
| 939,376 | A | 11/1909 | Appleton |
| 1,536,780 | A | 5/1925 | Ensign |

(Continued)

FOREIGN PATENT DOCUMENTS

| | | | |
|---|---|---|---|
| DE | 3816331 | A1 | 12/1988 |
| JP | 02169818 | A | 6/1990 |

OTHER PUBLICATIONS

Lindsay Publications Inc.; Lindsay Technical Archive; The Backus Gas Engine; American Machinist Magazine dated Jan. 15, 1891.

(Continued)

*Primary Examiner* — Noah Kamen
*Assistant Examiner* — Grant Moubry
(74) *Attorney, Agent, or Firm* — Wood, Herron & Evans, LLP

(57) ABSTRACT

A two-stroke engine includes a crankshaft that is rotatable about an axis, and an engine block that includes a combustion cylinder and a compression cylinder. A first piston is slidably disposed within the combustion cylinder and is operatively coupled to the crankshaft for reciprocating movement within the combustion cylinder through a power stroke during each rotation of the crankshaft about the axis. A second piston is slidably disposed within the compression cylinder and is operatively coupled to the crankshaft for reciprocating movement within the compression cylinder such that fresh air is received and compressed in the compression cylinder during each rotation of the crankshaft about the axis. A conduit provides fluid communication between the combustion cylinder and the compression cylinder, and a fuel injector is in communication with the combustion cylinder for admitting fuel into the combustion cylinder.

19 Claims, 4 Drawing Sheets

(56) References Cited

U.S. PATENT DOCUMENTS

| | | | | | |
|---|---|---|---|---|---|
| 1,555,807 | A | | 9/1925 | Burtnett | |
| 1,978,335 | A | | 10/1934 | Augustine | |
| 2,167,402 | A | | 7/1939 | Giro | |
| 2,202,761 | A | | 5/1940 | Fiedler | |
| 2,206,272 | A | | 7/1940 | Toth | |
| 2,265,677 | A | * | 12/1941 | Straub | 123/54.4 |
| 2,324,071 | A | | 7/1943 | Fiedler | |
| 2,522,649 | A | | 9/1950 | Tenney | |
| 2,609,802 | A | | 9/1952 | Schnurle et al. | |
| 3,203,409 | A | | 8/1965 | Allen | |
| 3,880,126 | A | | 4/1975 | Thurston et al. | |
| 3,916,851 | A | * | 11/1975 | Otani | 123/73 A |
| 4,821,692 | A | | 4/1989 | Browne | |
| 5,299,537 | A | * | 4/1994 | Thompson | 123/72 |
| 5,509,382 | A | | 4/1996 | Noland | |
| 5,857,436 | A | | 1/1999 | Chen | |
| 6,202,416 | B1 | | 3/2001 | Gray, Jr. | |
| 6,293,232 | B1 | | 9/2001 | Allen | |
| 6,571,755 | B1 | | 6/2003 | Dunn et al. | |
| 6,601,379 | B1 | * | 8/2003 | Tomczyk | 60/39.6 |
| 6,698,405 | B2 | * | 3/2004 | Bigi | 123/560 |
| 6,880,501 | B2 | | 4/2005 | Suh et al. | |
| 2002/0108589 | A1 | * | 8/2002 | Drecq | 123/66 |
| 2005/0268609 | A1 | | 12/2005 | Branyon et al. | |
| 2008/0105225 | A1 | | 5/2008 | Scuderi et al. | |
| 2011/0303185 | A1 | * | 12/2011 | Zajac et al. | 123/275 |
| 2013/0228158 | A1 | * | 9/2013 | Van Rooyen | 123/65 P |

OTHER PUBLICATIONS

Scuderi Group; Scuderi Powered Engine Information webpage dated May 13, 2009.

Scuderi Group; Scuderi Engine; First Scuderi Engine Prototype Unveiled Newsletter dated Apr. 20, 2009.

Peter Hofbauer; Stroke of Genius, Engine Expo 1999; OPOC Takes Two Article dated Jul. 10, 2007.

Umited States Patent and Trademark Office; Search Report and Written Opinion in International Patent Application No. OCT/2010/029193 dated May 21, 2011; 11 pages.

Chinese Patent Office; Office Action in Chinese Patent Application No. 201080025542.4 dated Apr. 17, 2014; 13 pages.

* cited by examiner

TWO-STROKE ENGINE AND RELATED METHODS

CROSS-REFERENCE

This application is a continuation of U.S. patent application Ser. No. 12/421,350 filed Apr. 9, 2009 now U.S. Pat. No. 8,505,504, the disclosure of which is incorporated by reference herein in its entirety.

TECHNICAL FIELD

The present invention relates generally to internal combustion engines, and more specifically, to an improved two-stroke engine.

BACKGROUND

Internal combustion engines are known for generating power that is used, for example, to drive a vehicle. In internal combustion engines, working fluids of the engine include air and fuel, as well as the products of combustion. Moreover, useful work is generated from the hot, gaseous expansion acting directly on moving surfaces of the engine, such as the crown of a piston, with reciprocating linear motion of the piston being converted into rotary motion of a crankshaft via a connecting rod or similar device.

Conventional internal combustion engines may be of a two-stroke or four-stroke type. In a conventional four-stroke engine, power is recovered from the combustion process in four separate piston movements or strokes of a single piston. In this type of engine, the piston moves through a power stroke once for every two revolutions of the crankshaft. On the other hand, in a conventional two-stroke engine, power is recovered from the combustion process in only two piston movements or strokes of that piston. In this type of engine, the piston moves through a power stroke once per revolution of the crankshaft.

Although two-stroke engines are known to have advantages over their four-stroke counterparts, their operation makes them somewhat undesirable in certain applications. For example, conventional two-stroke engines are known to have poor combustion control, which results in relatively high levels of emissions. In some cases, emissions associated with conventional two-stroke engines are too high to meet regulations addressing the emission of pollutants for vehicles. In addition, conventional two-stroke engines require the user to supply a mixture of fuel and oil in predetermined ratios in order to operate the engine, which may be inconvenient.

Accordingly, there is a need for a two-stroke engine that addresses these and other drawbacks associated with conventional two-stroke engines.

SUMMARY

In one embodiment, a two-stroke engine is provided. The engine comprises a crankshaft that is rotatable about an axis, and an engine block that includes a combustion cylinder and a compression cylinder. A first piston is slidably disposed within the combustion cylinder and is operatively coupled to the crankshaft for reciprocating movement within the combustion cylinder through a power stroke during each rotation (i.e., revolution) of the crankshaft about the axis. A second piston is slidably disposed within the compression cylinder and is operatively coupled to the crankshaft for reciprocating movement within the compression cylinder such that fresh air is received and compressed in the compression cylinder during each rotation (i.e., revolution) of the crankshaft about the axis.

A conduit provides fluid communication between the combustion cylinder and the compression cylinder, and a fuel injector is in communication with the combustion cylinder for admitting fuel into the combustion cylinder. First and second rotary valves in the engine block are operatively coupled to the crankshaft for rotation relative to the crankshaft. The first and second rotary valves are respectively rotatable to selectively admit fresh air into the compression cylinder and to permit the flow of compressed air into the conduit. The first and second rotary valves are operable such that air compressed in the compression cylinder is transferred through the conduit to the combustion cylinder and scavenges substantially all contents of the combustion cylinder before the fuel is admitted to the combustion cylinder by the fuel injector.

In specific embodiments, each of the first and second rotary valves is operatively coupled to the crankshaft for rotation at about half the speed of rotation of the crankshaft. In one aspect of particular embodiments, the conduit may define a first volume for holding air and the combustion cylinder may define a first maximum volume for holding air and fuel, with the first volume being larger than the maximum volume of the combustion cylinder. Additionally or alternatively, the compression cylinder may define a second maximum volume for holding air that is larger than the first maximum volume of the combustion cylinder. The conduit may include a plurality of fins for cooling air in the conduit. The first rotary valve, in one embodiment, includes a first passage that extends generally transverse to a rotational axis of the first rotary valve, and wherein rotation of the first rotary valve intermittently provides fluid communication between the compression cylinder and the conduit through the first passage. The second rotary valve may include a second passage that extends generally transverse to a rotational axis of the second rotary valve, wherein rotation of the second rotary valve intermittently provides fluid communication between the compression cylinder and an outside source of air through the second passage.

The first and second rotary valves may be positioned proximate an end of the compression cylinder and may be rotatable about respective axes that are generally parallel to one another and generally parallel to a rotational axis of the crankshaft. The fuel injector may be operatively coupled to the conduit for injecting fuel into the conduit. The engine may additionally comprise an exhaust duct that is in fluid communication with the combustion cylinder for evacuating spent gases from the combustion cylinder. The exhaust duct may expand from a first cross-sectional area at a location proximate the combustion cylinder to a second cross-sectional area that is larger than the first cross-sectional area at another location that is distal of the combustion cylinder. The exhaust duct may comprise at least one sidewall that is inclined at an angle of about 45° relative to a longitudinal axis of the exhaust duct.

DETAILED DESCRIPTION

Figure 1:
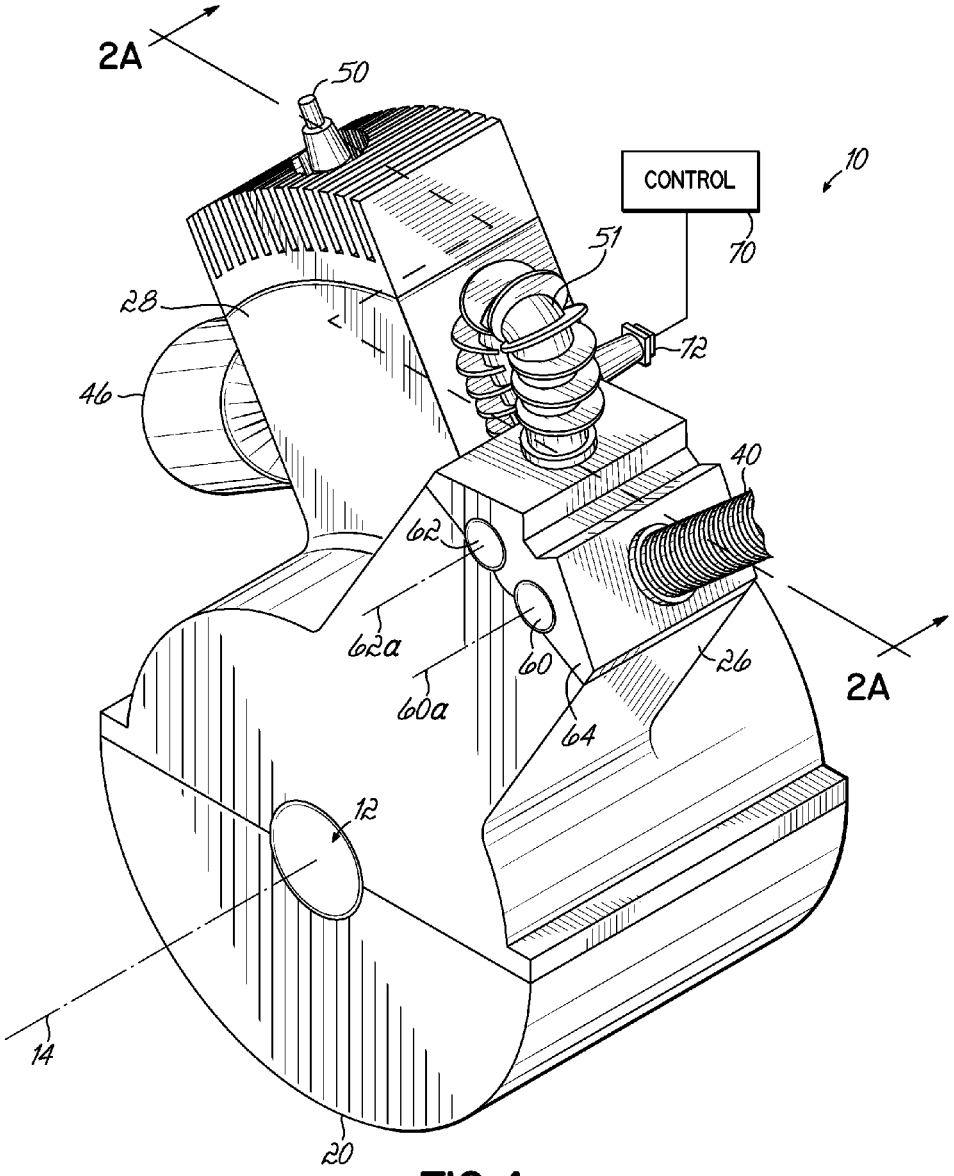
FIG. 1 is a schematic perspective view of an exemplary embodiment of a two-stroke engine in accordance with the present disclosure.

With reference to the figures and, in particular, FIG. 1, an exemplary two-stroke engine 10 in accordance with the present disclosure includes a crankshaft 12 that is rotatable about a rotational axis 14, and which is disposed within an engine block 20 of the engine 10. The engine 10 includes a compression cylinder 26 and a combustion cylinder 28, as well as first and second pistons 36, 38 (FIG. 2A) that are slidably disposed, respectively, in the compression and combustion cylinders 26, 28. Engine block 20 is connected to a supply of air through a conduit 40, and to a supply of fuel (not shown), with a mixture of the fuel and air delivered to the combustion cylinder 28 for combustion, as explained in further detail below. The remnants of the combustion are evacuated from the engine block 20 through an exhaust duct 46. A spark plug 50 is coupled to the combustion cylinder 28, and provides a source of ignition for combustion of the air/fuel mixture in the combustion cylinder 28. Supply of air through conduit 40 into the compression cylinder 26, and from the compression cylinder 26 to the combustion cylinder 28 through a conduit 51, is controlled by the rotation of a pair of rotary valves 60, 62 disposed in a head portion 64 of the compression cylinder 26. A control unit 70 controls operation of the engine 10, in particular the flow of fuel through a fuel injector 72 into the combustion cylinder 28, as explained in further detail below.

The first and second rotary valves 60, 62 of this exemplary embodiment are generally parallel to one another, and rotate about respective first and second axes 60*a*, 62*a* that are in turn generally parallel to the rotational axis 14 of the crankshaft 12. The first and second rotary valves 60, 62 are coupled to the crankshaft 12, for example, through gears (not shown), such that rotation of the crankshaft 12 induces rotation of the rotary valves 60, 62. More specifically, in this exemplary embodiment, coupling between the crankshaft 12 and the first and second rotary valves 60, 62 is such that the rotary valves 60, 62 are rotatable relative to the crankshaft 12. For example, and without limitation, coupling between the first and second rotary valves 60, 62 with the crankshaft 12 may be such that the rotary valves 60, 62 rotate at about half the speed of rotation of the crankshaft 12. In this exemplary embodiment, moreover, the position of the first and second rotary valves 60, 62 may be such that each is located about halfway between a center of the compression cylinder 26 and a sidewall thereof.

Referring now to FIGS. 2A-2D, operation of the two-stroke engine 10 is illustrated. As discussed above, the first and second pistons 36, 38 are slidably disposed within the compression and combustion cylinders 26, 28, respectively, for reciprocating movement within the compression and combustion cylinders 26, 28. The first and second pistons 36, 38 are in turn operatively coupled to the crankshaft 12 through respective first and second connecting rods 80, 82 eccentrically coupled to the crankshaft 12. Accordingly, the reciprocating linear movement of the first and second pistons 36, 38 causes rotation of the crankshaft 12, for example, in the general direction of arrow 85. Though not shown, crankshaft 12 is in turn coupled to a pulley or drivetrain, to thereby provide a source of power, for example, to a vehicle on which the engine 10 is mounted.

Figure 2A:
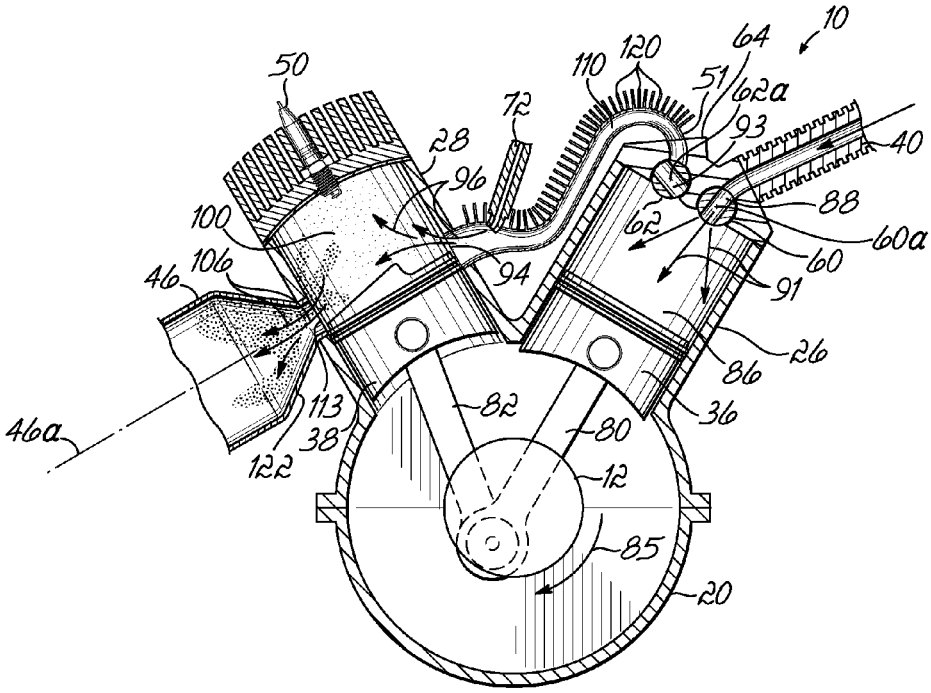
FIG. 2A is a cross-sectional view taken generally along line 2A-2A of FIG. 1, showing first and second pistons thereof in respective first orientations.

With particular reference to FIG. 2A, the first rotary valve 60 is shown in an open position, thereby providing fluid communication between the conduit 40 supplying the air and the compression cylinder 26. More specifically, the first rotary valve 60 includes a first passage 88 extending generally transverse to the rotational axis 60*a* of the first rotary valve 60 such that rotation thereof intermittently provides fluid communication, as illustrated in the figure, between an interior of the compression cylinder 26 and the conduit 40 supplying the air. Similarly, the second rotary valve 62 includes a second passage 93 extending generally transverse to the rotational axis 62*a* of the second rotary valve 62 such that rotation thereof intermittently provides fluid communication between the interior of compression cylinder 26 and the conduit 51.

In FIG. 2A, the first rotary valve 60 is an open position, such that air from conduit 40 fills the interior of the compression cylinder 26 (arrows 91), when the first piston 36 is in a position defining a first maximum volume 86 for holding air of the compression cylinder 26, as illustrated in FIG. 2A. The illustrated position of the first piston 36 corresponds to a bottom-most position of the first piston 36. Rotation of the first rotary valve 60 away from the position generally shown in FIG. 2A results in closing of the first rotary valve 60, which thereby closes any fluid communication between the conduit 40 supplying the air and the compression cylinder 26. In the view shown (FIG. 2A), the second rotary 62 valve is in a closed position, i.e., such that no flow is permitted between the compression cylinder 26 and the conduit 51.

In the view illustrated in FIG. 2A, moreover, the second piston 38 is in a position within the combustion cylinder 28, such that there is fluid communication between the conduit 51 and the combustion cylinder 28 through a port 94 of the combustion cylinder 28. This fluid communication permits the flow of air or a mixture of fuel and air from the conduit 51 into the combustion cylinder 28, as illustrated generally by arrows 96. The illustrated bottom-most position of the second piston 38 defines a maximum holding volume 100, for holding the air/fuel mixture within the combustion cylinder 28.

In one aspect of this embodiment, the volume of air flowing from the conduit 51 and into the combustion cylinder 28 is such that substantially all of the contents of the combustion cylinder 28 are scavenged by the air flowing from conduit 51 into combustion cylinder 28. In this regard, substantially all of the contents (e.g., spent gases and uncombusted remnants, if any) that were previously held in the combustion cylinder 28 are evacuated through exhaust duct 46 (arrows 106). In this particular embodiment, substantially complete scavenging of the contents of the combustion cylinder 28 is facilitated by the shape and dimensions of the conduit 51, as well as the dimensions of the compression cylinder 26 relative to the dimensions of the combustion cylinder 28. More particularly, in this embodiment, the shape and dimensions of the conduit 51 define a holding volume 110 for compressed air in the conduit 51 that is larger than the maximum volume 100 for holding the air/fuel mixture of the combustion cylinder 28, such that when pressurized air in the conduit 51 flows into the combustion cylinder 28, substantially all of the contents of the combustion cylinder 28 are displaced by the clean air and evacuated through the exhaust duct 46.

Similarly, the maximum volume 86 of the compression cylinder 26 is larger than the maximum volume 100 of the combustion cylinder 28 to further facilitate substantially complete scavenging of the contents of combustion cylinder 28. More specifically, compression cylinder 26 supplies a large enough volume of compressed air to conduit 51 to enable such substantially complete scavenging. For example, and without limitation, the volume of air available for scavenging from the conduit 51 may be in excess of about 100% of the maximum volume 100 of the combustion cylinder 28, such that a portion of the clean air supplied by conduit 51 is allowed to flow out of the combustion cylinder 28 through exhaust duct 46 prior to closing of a port 113 communicating the interior of combustion cylinder 28 with exhaust duct 46. Accordingly, not only are all the remnants of combustion evacuated from combustion cylinder 28 by the scavenging air, but rather even some of the clean air is evacuated as well, thereby providing substantially complete scavenging of the contents of combustion cylinder 28. In this embodiment, the fuel injector 72 that is coupled to the conduit 51 is controlled by control unit 70 that directs the fuel injector 72 to supply fuel into the conduit 51 only after substantially all of the spent gases of the combustion cylinder 28 have been evacuated. For example, and without limitation, control unit 70 may direct the fuel injector 72 to supply fuel to conduit 51 only after at least about 15% of the compressed air in conduit 51 has flown into the combustion cylinder 28. This operation thereby permits a substantially clean mixture of air and fuel to be present in the combustion cylinder 28 prior to combustion, with virtually no remnants of any prior combustion being present in the combustion cylinder 28.

Figure 2B:
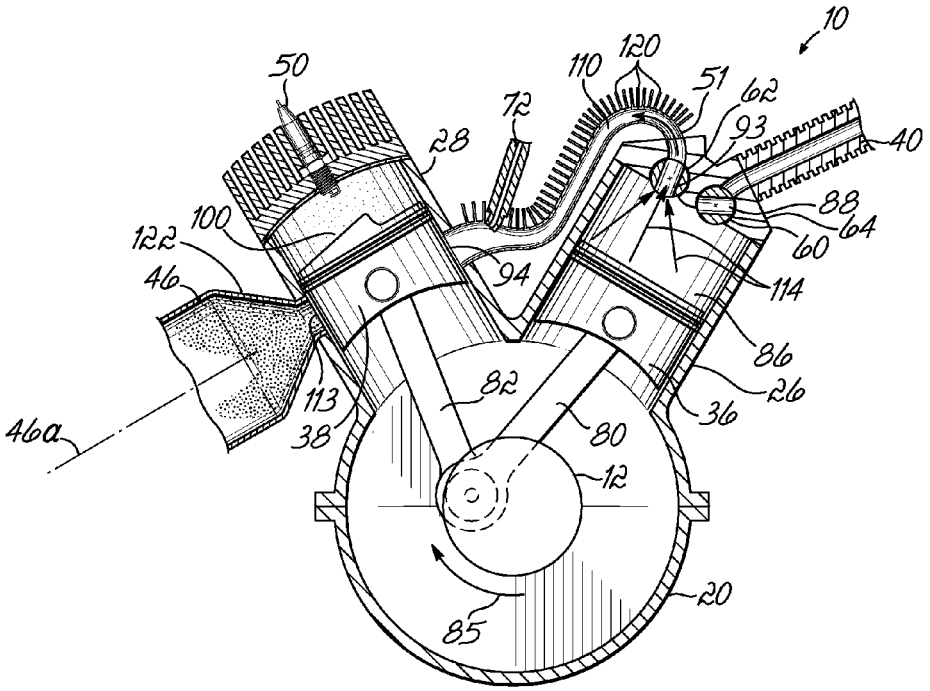
FIG. 2B is a view similar to FIG. 2A showing the first and second pistons in respective orientations different from those of FIG. 2A.

With reference to FIG. 2B, the first rotary valve 60 is shown in a closed position, while the second rotary valve 62 is shown in an open position, thereby providing fluid communication between the compression cylinder 26 and the conduit 51. In this regard, the air is compressed by movement of first piston 36 in a direction toward the head portion 64 of the compression cylinder 26. The compressed air flows from compression cylinder 26 and into conduit 51 (arrows 114) through the second passage 93 of second rotary valve 62. The conduit 51 of this exemplary embodiment has a plurality of fins 120 extending from the main portion of the conduit 51 that permit heat transfer between the air in the conduit 51 and the surrounding environment, to thereby control the temperature of the air passing through the conduit 51. In this regard, for example, the temperature of the air in conduit 51 may be controlled to be less than about 180° F. In the view shown (FIG. 2B), the first piston 36 is shown in the compression cylinder 26 moving toward the head portion 64, while the second piston 38 is shown blocking fluid communication between the combustion cylinder 28 and the conduit 51 and blocking fluid communication between combustion cylinder 28 and the exhaust duct 46, thereby permitting air to be compressed by first piston 36 into conduit 51. For example, and without limitation, air in conduit 51 may be pressurized to less than about 60 psi. Further, in the illustrated position of the second piston 38, the second piston 38 is moving upwardly, thereby compressing the mixture of air and fuel that is held in the combustion cylinder 28.

Figure 2C:
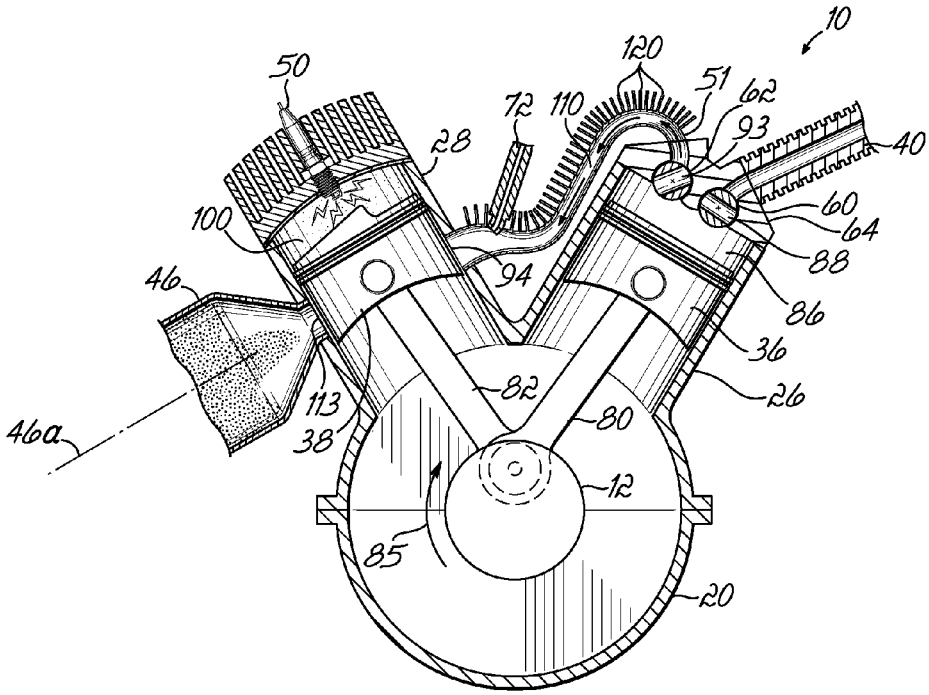
FIG. 2C is a view similar to FIGS. 2A and 2B showing the first and second pistons in respective orientations different from those of FIGS. 2A and 2B.

With reference to FIG. 2C, the second piston 38 is shown having reached a target position within the combustion cylinder 28, and the spark plug 50 is shown igniting the air and fuel mixture held in the combustion cylinder 28, to thereby initiate a power stroke of the second piston 38. In FIG. 2C, the second rotary valve 62 is in a closed position such that none of the air held in the conduit 51 is permitted to flow back into the compression cylinder 26. Moreover, the position of the second piston 38 within combustion cylinder 28 is such that fluid communication is blocked between combustion cylinder 28 and conduit 51 and the exhaust 46. As the second piston 38 moves downward in the power stroke (i.e., toward the position shown in FIG. 2A), fluid communication is re-established between the combustion cylinder 28 and the exhaust duct 46, such that the remnants of combustion are evacuated from the combustion cylinder 28 and through the exhaust duct 46.

Figure 2D:
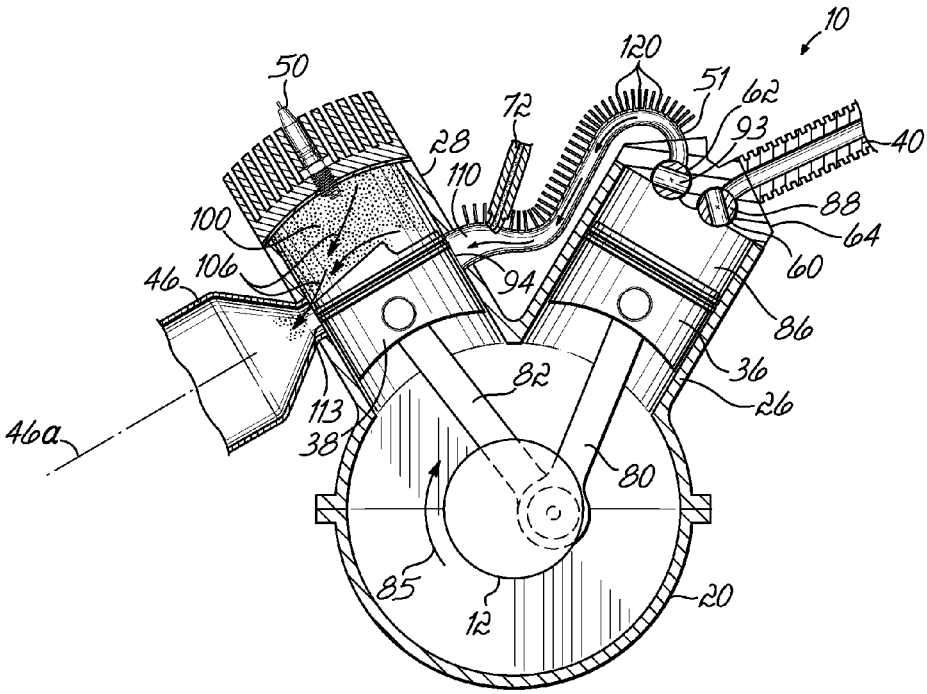
FIG. 2D is a view similar to FIGS. 2A-2C showing the first and second pistons in respective orientations different from those of FIGS. 2A-2C.

In the view illustrated in FIG. 2D, the first piston 36 is moving downward to permit subsequent filling of compression cylinder 26 with fresh air (as described above), and the second piston 38 is moving downward to permit spent gases from the combustion cylinder 28 to flow through exhaust duct 46. As the second piston 38 advances toward its bottom-most position (FIG. 2A) and passes port 94 and exhaust port 113, clean air flows from the conduit 51 into the combustion cylinder 28 and substantially displaces all of the remnants of combustion that may be present in the combustion cylinder 28. The spent gases will also begin to flow out of combustion cylinder 28 and through exhaust duct 46

As noted above, movement of the second piston 38 within the combustion cylinder 28 from the top-most position towards the position generally shown in FIG. 2A defines a power stroke of the engine 10. Likewise, movement of the second piston 38 within the combustion cylinder 28 from the position generally shown in FIG. 2A to the position generally shown in FIG. 2C defines an intake, exhaust, and compression stroke of the engine 10.

As illustrated by the sequence shown in FIGS. 2A-2D, the two strokes of the first piston 36 as well as the two strokes of the second piston 38 occur during a single rotation (i.e., revolution) of the crankshaft 12. This type of operation and, particularly, the two strokes of the second piston 38 within combustion cylinder 28 thereby define a two-stroke operation of the engine 10. In this two-stroke operation, the substantially complete scavenging of the spent gases from the combustion cylinder 28, and the timing in which the control unit 70 directs the fuel injector 72 to inject fuel into the conduit 51, result in substantially complete atomization of the fuel that is injected into the engine 10. Substantially complete scavenging also prevents the mixing or contamination of unburned raw fuel in the combustion cylinder 28 with new fuel or clean air that is directed into the combustion cylinder 28. This operation eliminates or at least significantly reduces the formation of hydrocarbons.

In the exemplary embodiment illustrated in the figures, the location of the fuel injector 72 in the conduit 51, as well as the controlled timing for injecting the fuel into the conduit 51, is such that the fuel is injected directly into relatively high velocity, high temperature compressed scavenging air flowing through the conduit 51 into the combustion cylinder 28, which provides sufficient time for complete atomization of the fuel. Complete atomization, in turn, minimizes the cold start up problems observed with conventional engines, especially when using alcohol-based fuels. It is contemplated that, alternatively, the fuel injector 72 may be coupled directly to the combustion cylinder 28 rather than being coupled directly to conduit 51.

The exhaust duct 46 in this exemplary embodiment varies in cross-sectional shape from the location of coupling with the combustion cylinder 28 to a location away from the combustion cylinder 28. More specifically, the exhaust duct 46 in this embodiment has a larger cross-sectional area at a location distal of the combustion cylinder 28 relative to a location adjacent the port 113 of combustion cylinder 28. In this specific embodiment, moreover, the exhaust duct 46 includes sidewalls 122 that define an angle of about 45° relative to a longitudinal axis 46*a* (FIG. 2A) of the exhaust duct 46. This configuration permits a relatively low-pressure, easy flow of the spent contents of the combustion cylinder 28 through the exhaust duct 46.

The above-described engine may use different types of fuel, such as alcohol-based renewable fuels, hydrogen, or propane, without the need for the addition of lubricating oil to the fuel. This allows a significant increase in fuel economy and power output of the engine, as well as a reduction of engine emissions when compared to conventional two-stroke or four-stroke engines. Moreover, the relatively small number of parts of the engine 10 provides a reduction in weight compared to conventional engines. The relatively small number of parts also results in a reduced cost of manufacturing of the engine. It is estimated that this engine can reach a thermal efficiency of 1.25 due to the substantially complete elimination of hot, residual gases from the combustion cylinder 28 which also results in the reduction or elimination of parasitic losses, when compared to conventional two-stroke and four-stroke engines.

While the figures illustrate an engine having one combustion cylinder and one compression cylinder, those of ordinary skill in the art will readily appreciate that engines having any even number of cylinders may be suitable to apply the principles described above. For example, and without limitation, an engine could have an even number of cylinders with predefined pairs of compression and combustion cylinders, with each of the compression cylinders being in fluid communication with one of the compression cylinders in the manner generally illustrated in the above figures and described above. In such multi-cylinder engine, a plurality of fuel injectors may be present and be independently controlled or alternatively controlled by a single control unit. In such an engine, moreover, a plurality of spark plugs may be operatively (e.g., electrically) coupled to one another and coupled to an ignition device through wires in ways known to those skilled in the art. Moreover, it will be appreciated that various conventional engines currently configured to operate with gasoline can be converted to conform with the structure and operation of the exemplary engines shown and described herein. Engines according to the present disclosure may also have various configurations or arrangements of cylinders, such as in-line arrangements, V-shaped arrangements, opposing cylinders, or various other configurations.

Figure 3:
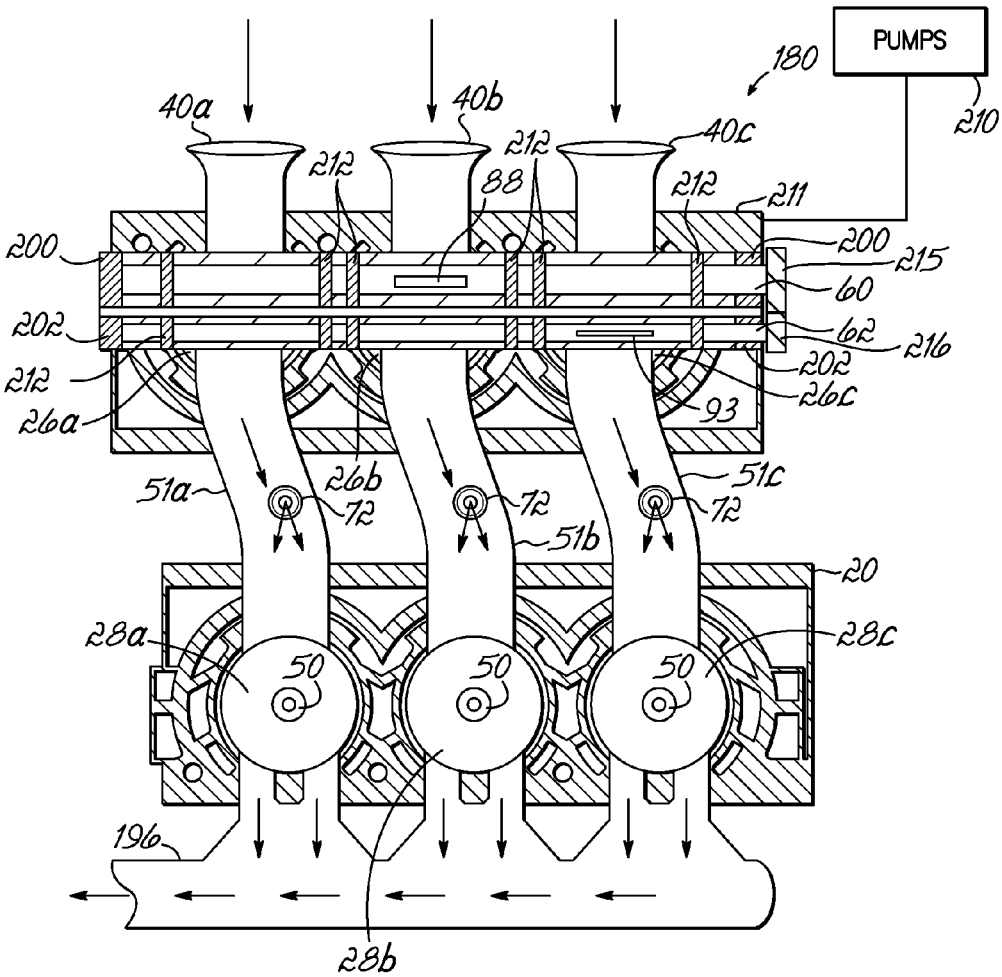
FIG. 3 is a schematic top view of another exemplary embodiment of a two-stroke engine in accordance with the present disclosure.

An exemplary engine having more than one compression cylinder and more than one combustion cylinder is illustrated in FIG. 3, in which similar reference numerals refer to similar features of the preceding figures. FIG. 3 illustrates an exemplary engine 180 having three compression cylinders 26*a*, 26*b*, and 26*c*, respectively in fluid communication with three combustion cylinders 28*a*, 28*b*, 28*c*, through respective conduits 51*a*, 51*b*, and 51*c*. Air is supplied to each of the compression cylinders 26*a*, 26*b*, 26*c* through respective conduits 40*a*, 40*b*, 40*c* while fuel is supplied to the compression cylinders 28*a*, 28*b*, 28*c* through respective fuel injectors 50. Spent gases and air from each of the combustion cylinders 28*a*, 28*b*, 28*c* is evacuated from the engine 180 through a common exhaust duct 196, as schematically depicted in the figure. Sets of bearings 200, 202 respectively support each of the rotary valves 60, 62 of the engine 180 for respective rotation thereof, while schematically depicted pumps 210 supply oil, fuel, and/or a coolant fluid to an engine block 211 of engine 180. A plurality of seals 212 are disposed between the compression cylinders 26*a*, 26*b*, 26*c* to prevent the flow of fluids between them, while the bearings 200 are sealed and/or are lubricated by oil supplied by the pumps 210. In one aspect of this embodiment, a coolant supplied by the pumps 210 can be used to cool the air in the conduits 51*a*, 51*b*, 51*c*, the compression cylinders 26*a*, 26*b*, 26*c*, and/or the combustion cylinders 28*a*, 28*b*, 28*c*. A pair of gears 215, 216, control rotation of the rotary valves 60, 62 and are coupled to the crankshaft (not shown in this figure).

While the present invention has been illustrated by a description of various embodiments and while these embodiments have been described in considerable detail, it is not intended to restrict or in any way limit the scope of the appended claims to such detail. The various features shown and discussed herein may be used alone or in combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A two-stroke engine comprising:

a crankshaft rotatable about an axis;

an engine block including a combustion cylinder and a compression cylinder;

a first piston slidably disposed within said combustion cylinder and operatively coupled to said crankshaft for reciprocating movement within said combustion cylinder through a power stroke during each rotation of said crankshaft about said axis;

a second piston slidably disposed within said compression cylinder and operatively coupled to said crankshaft for reciprocating movement within said compression cylinder such that fresh air is received and compressed in said compression cylinder during each rotation of said crankshaft about said axis;

a conduit providing fluid communication between said combustion cylinder and said compression cylinder;

a fuel injector in communication with said combustion cylinder for admitting fuel into said combustion cylinder;

first and second rotary valves in said engine block and operatively coupled to said crankshaft for rotation relative to said crankshaft, said first and second rotary valves being respectively rotatable to selectively admit fresh air into said compression cylinder and to permit the flow of compressed air into said conduit;

said first and second rotary valves operable such that air compressed in said compression cylinder is transferred through said conduit to said combustion cylinder and scavenges substantially all contents of said combustion cylinder before fuel is admitted to said combustion cylinder by said fuel injector;

wherein said conduit defines a first volume for holding air and said combustion cylinder defines a first maximum volume for holding a mixture of air and fuel, said first volume of said conduit being larger than said first maximum volume of said combustion cylinder for scavenging substantially all contents of said combustion cylinder plus an additional volume of clean air.

2. The engine of claim 1, wherein each of said first and second rotary valves is operatively coupled to said crankshaft for rotation at about half the speed of rotation of said crankshaft.

3. The engine of claim 1, wherein said compression cylinder defines a second maximum volume for holding air larger than said first maximum volume for scavenging substantially all contents of said combustion cylinder plus an additional volume of clean air.

4. The engine of claim 1, wherein said conduit includes a plurality of fins for controlling the temperature of air in said conduit.

5. The engine of claim 1, wherein said first rotary valve includes a first passage extending generally transverse to a rotational axis of said first rotary valve, and wherein rotation of said first rotary valve intermittently provides fluid communication between said compression cylinder and an outside source of air.

6. The engine of claim 1, wherein said second rotary valve includes a second passage extending generally transverse to a rotational axis of said second rotary valve, and wherein rotation of said second rotary valve intermittently provides fluid communication between said compression cylinder and said conduit through said second passage.

7. The engine of claim 1, wherein said first and second rotary valves are positioned proximate an end of said compression cylinder and are rotatable about respective axes that are generally parallel to one another and generally parallel to a rotational axis of said crankshaft.

8. The engine of claim 1, wherein said fuel injector is fluidly coupled to said combustion cylinder for injecting fuel into said combustion cylinder.

9. The engine of claim 1, further comprising:

an exhaust duct in fluid communication with said combustion cylinder for evacuating spent gases from said combustion cylinder, said exhaust duct expanding from a first cross-sectional area at a location proximate said combustion cylinder to a second cross-sectional area larger than said first cross-sectional area at another location distal of said combustion cylinder.

10. The engine of claim 9, wherein said exhaust duct comprises at least one sidewall inclined at an angle of about 45 degrees relative to a longitudinal axis of said exhaust duct.

11. The engine of claim 1, wherein said fuel injector is coupled to said conduit.

12. The engine of claim 1, wherein said engine block defines a head portion of said compression cylinder, said first and second rotary valves being disposed in said head portion.

13. A method of manufacturing a two-stroke engine, the method comprising:

coupling a crankshaft to first and second pistons respectively reciprocatingly movable within a combustion cylinder and a compression cylinder of the engine;

fluidly coupling the combustion and compression cylinders to one another through a conduit;

providing a pair of valves to control the flow of air into the compression cylinder and from the compression cylinder to the conduit to pressurize the air in the conduit; and providing a holding volume for air in at least one of the compression cylinder and the conduit operable to exhaust from the combustion cylinder substantially all remnants of combustion and a predetermined volume of clean air, the holding volume being greater than a first maximum volume defined by the combustion cylinder for holding a mixture of air and fuel.

14. A method of generating power in a two-stroke engine, the method comprising:

reciprocating first and second pistons respectively within a combustion cylinder and a compression cylinder of the engine, the first and second pistons coupled to a crankshaft for rotating the crankshaft and thereby generate power;

directing a volume of air to the combustion cylinder, the volume of air being greater than a first maximum volume defined by the combustion cylinder for holding a mixture of air and fuel;

directing fuel into the combustion cylinder;

combusting a mixture of air and fuel in the combustion cylinder; and exhausting spent gases and a predetermined volume of clean air from the combustion cylinder.

15. The method of claim 14, further comprising:

controlling admission of fuel into the combustion cylinder such that at least about 15% of the air available from the conduit is allowed to flow into the combustion cylinder and out through an exhaust thereof prior to the admission of fuel.

16. The method of claim 14, further comprising:

controlling the temperature of the air in the conduit to less than about 180° F.

17. The method of claim 14, further comprising:

controlling the pressure of the air in the conduit to less than about 60 psi.

18. The method of claim 14, further comprising:

controlling a supply of a fluid into the engine to cool at least one of the combustion cylinder, the compression cylinder, or the conduit.

19. The method of claim 14, further comprising:

coupling the engine to a source of oil-free fuel, the fuel comprising one of an alcohol-based renewable fuel, hydrogen, or propane.

* * * * *